US007887372B2

(12) United States Patent
Lee et al.

(10) Patent No.: US 7,887,372 B2
(45) Date of Patent: Feb. 15, 2011

(54) FASTENING DEVICE FOR LOW-PROFILE FUSES OF VEHICLE

(75) Inventors: Chul-Sub Lee, Seoul (KR); Cheol-Min Park, Seoul (KR)

(73) Assignee: Tyco Electronics AMP Korea Ltd., Kyungsangbuk-Do (KR)

( * ) Notice: Subject to any disclaimer, the term of this patent is extended or adjusted under 35 U.S.C. 154(b) by 0 days.

(21) Appl. No.: 12/244,476

(22) Filed: Oct. 2, 2008

(65) Prior Publication Data

US 2009/0088017 A1 Apr. 2, 2009

(30) Foreign Application Priority Data

Oct. 2, 2007 (KR) ..... 10-2007-0099526

(51) Int. Cl.
*H01R 13/68* (2006.01)

(52) U.S. Cl. ..... 439/620.34

(58) Field of Classification Search ..... 439/620.33, 439/620.34, 620.27, 374, 953
See application file for complete search history.

(56) References Cited

U.S. PATENT DOCUMENTS 1,922,500 A * 8/1933 Pierce ..... 337/245
5,171,293 A * 12/1992 Umemoto et al. ..... 439/620.33
5,816,858 A 10/1998 Kazarian et al.
6,033,252 A * 3/2000 Hood et al. ..... 439/374
6,406,331 B1 * 6/2002 Brown ..... 439/620.33
2009/0088026 A1 * 4/2009 Furuya et al. ..... 439/620.27

* cited by examiner

*Primary Examiner*—Phuong K Dinh
(74) *Attorney, Agent, or Firm*—Barley Snyder LLC

(57) ABSTRACT

A fastening device for a low-profile fuses of vehicle, which can achieve simple and robust coupling of the low-profile fuse while enabling the fuse to be easily connected to or disconnected from a vehicular junction box, is disclosed. The fastening device serves to connect or disconnect the low-profile fuse to or from the junction box via upward/downward movement thereof while maintaining coupling between the low-profile fuse and the junction box, and includes a socket integrally formed at an upper surface of the junction box and having plug coupling recesses and a fuse connecting recess indented in the upper surface of the junction box, terminals being disposed inside the fuse connecting recess so as to be exposed to the outside, and a plug vertically movably coupled in the socket while being coupled laterally with the low-profile fuse to enable connection or disconnection between the low-profile fuse and the terminals.

14 Claims, 8 Drawing Sheets

FASTENING DEVICE FOR LOW-PROFILE FUSES OF VEHICLE

CROSS-REFERENCE TO RELATED APPLICATIONS

This application claims the benefit of the filing date under 35 U.S.C. §119(a)-(d) of Korean Patent Application No. 10-2007-0099526, filed Oct. 2, 2007.

FIELD OF THE INVENTION

The present invention relates to a fastening device for a low-profile fuse of vehicle, and more particularly, to a fastening device which can achieve simple and robust coupling of a low-profile fuse while enabling the low-profile fuse to be easily connected to or disconnected from a vehicular junction box.

BACKGROUND

Generally, a vehicular junction box is used to receive a plurality of fuses for various electric devices and is continuously exposed to slight current. When a vehicle is not used for a long time, the slight current passing through the junction box may cause battery discharge and consequently, difficulty in engine starting.

A vehicular junction box is therefore provided with a main fuse to disconnect or connect all circuits of a vehicle. The main fuse is separated from the junction box during long-periods of non use of a vehicle, for example, export shipping of a vehicle, in order to prevent current from flowing through the junction box and consequently, prevent battery discharge.

However, completely separating the main fuse from the junction box entails a risk of loss of the main fuse. Therefore, to eliminate this problem, as shown in FIGS. 6 and 7, a fuse fastening device 300 has been developed, by which a fuse 200 can be moved upward or downward while being coupled in a junction box 100, so as to be connected to or disconnected from the junction box 100.

In the above-described conventional fuse fastening device 300, as best shown in FIG. 7, the fuse 200 is inserted into the fuse fastening device 300 from an upper end such that connecting terminals 201 of the fuse 200 protrude downward into the fuse fastening device 300. If the fuse fastening device 300, integrally coupled with the fuse 200, is moved downward, the connecting terminals 201 of the fuse 200 are inserted into and connected to the junction box 100, achieving power connection throughout a vehicle. If the fuse fastening device 300 is moved upward, the connecting terminals 201 of the fuse 200 are separated and electrically disconnected from the junction box 100 while the fuse fastening device 300 is still mechanically coupled to the junction box 100.

Recently, to provide a light-weight vehicle and a miniaturized junction box, a low-profile fuse, having a smaller size than conventional fuses, has been developed. Such a low-profile fuse has a significantly lower height and thus, connecting terminals thereof are configured to protrude laterally from the fuse. Therefore, it is difficult to connect the low-profile fuse to a junction box by inserting the fuse into the fuse fastening device from the upper end of the device as described above. Moreover, it is difficult to maintain efficient connection between the low-profile fuse and the junction box.

SUMMARY

Therefore, the present invention has been made in view of the above problems, and it is an object of the present invention to provide a fastening device for a low-profile vehicular fuse, which can achieve not only simple separation/coupling of the low-profile fuse, but also efficient connection between the low-profile fuse and a junction box while maintaining plug-and-socket coupling thereof.

It is another object of the present invention to provide a fastening device for a low-profile vehicular fuse, which can prevent a low-profile fuse from being tilted laterally during upward or downward movement of a plug thereof.

It is a further object of the present invention to provide a fastening device for a low-profile vehicular fuse, wherein a plug of the fastening device can be firmly fixed to the low-profile fuse while being easily movable upward or downward within a socket with a simplified configuration.

It is another object of the present invention to provide a fastening device for a low-profile vehicular fuse, which can achieve an enhanced fastening force with respect to the low-profile fuse during downward movement of a plug thereof.

It is a still further object of the present invention to provide a fastening device for a low-profile vehicular fuse, wherein a plug of the fastening device can be firmly fixed at the maximum upwardly or downwardly moved position thereof.

It is a still further object of the present invention to provide a fastening device for a low-profile vehicular fuse, wherein a pair of low-profile fuses can be coupled simultaneously to a single plug of the fastening device.

In accordance with the present invention, the above and other objects can be accomplished by a fastening device for a low-profile vehicular fuse. A socket is integrally formed at an upper surface of a junction box and has a pair of plug coupling recesses and a fuse connecting recess, which are indented in the upper surface of the junction box. Terminals are disposed inside the fuse connecting recess so as to be exposed to the outside. A plug is vertically movably coupled in the socket while being coupled laterally with the low-profile fuse to enable connection or disconnection between the low-profile fuse and the terminals inside the fuse connecting recess.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENTS

Figure 1:
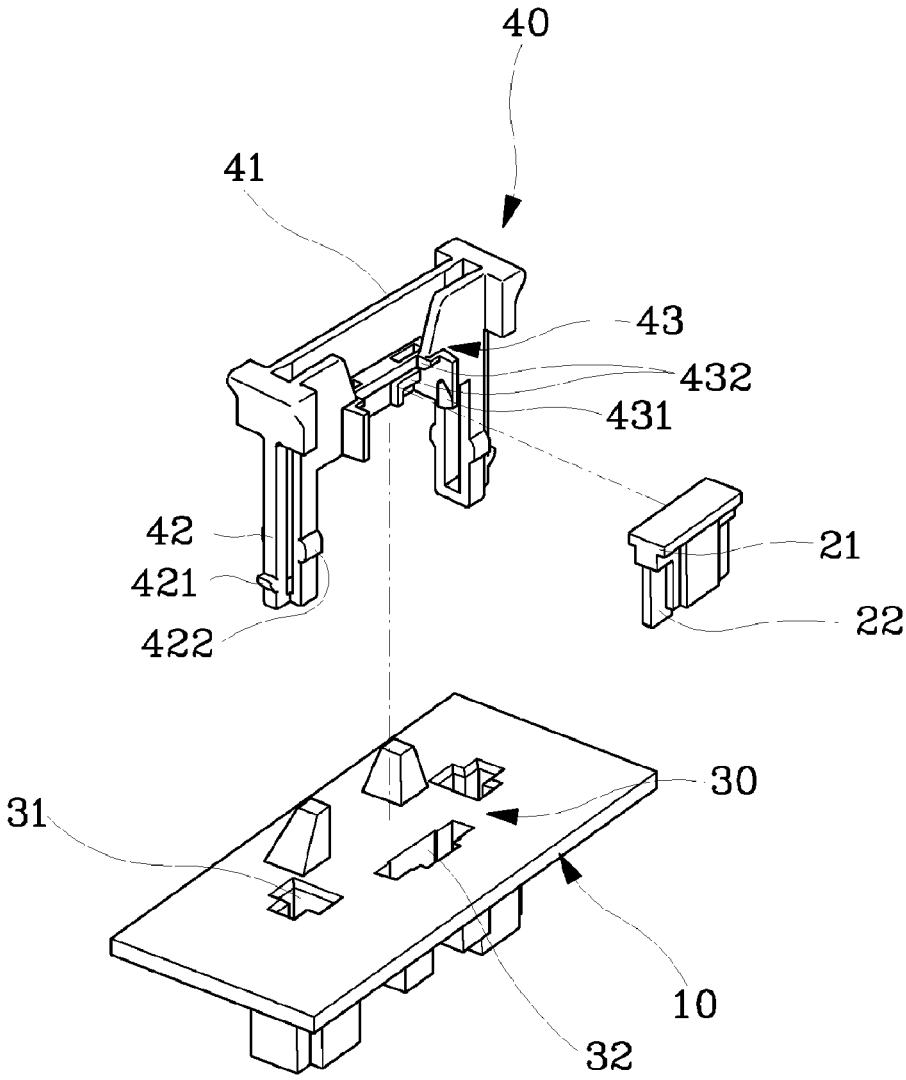
FIG. 1 is an exploded perspective view of a first embodiment of the present invention.

As shown in FIG. 1, a fastening device for a low-profile vehicular fuse 20 has laterally-protruding connecting terminals 22. The fastening device has a socket 30 integrally formed at an upper surface of a vehicular junction box 10, and a plug 40 coupled into the socket 30 to connect or disconnect the low-profile fuse 20 to or from the junction box 10 via upward or downward movement thereof. More particularly, the low-profile fuse 20 is inserted into the plug 40 from one side of the plug 40, whereby the fastening device can achieve not only simple and robust coupling of the low-profile fuse 20, but also efficient connection/disconnection between the low-profile fuse 20 and the junction box 10.

The socket 30 is integrally formed at the upper surface of the vehicular junction box 10 in which a plurality of fuses and relays, etc. is mounted. The socket 30 has plug coupling recesses 31 indented in the upper surface of the junction box 10, along which vertically-movable guides 42 of the plug 40, as will be described hereinafter, which are movable upward or downward. A fuse connecting recess 32 receives the low-profile fuse 20 and terminals (not shown) are disposed inside the fuse connecting recess 32 to enable connection with the connecting terminals 22 of the low-profile fuse 20. Specifically, if the plug 40 is completely moved downwardly, the connecting terminals 22 of the low-profile fuse 20 are connected to the terminals (not shown) inside the fuse connecting recess 32. If the plug 40 is moved upwardly, the connecting terminals 22 of the low-profile fuse 20 are electrically disconnected from the socket 30.

The plug 40 serves to receive the low-profile fuse 20 and keep it at a fixed position. The plug 40 is vertically movably coupled in the above-described socket 30, to connect or disconnect the low-profile fuse 20 to or from the junction box 10. The plug 40 consists of a plug body 41 configured to allow a user to easily pull up or push down the plug 40 by hand. Serving to support the low-profile fuse 20, a pair of vertically-movable guides 42 symmetrically protrude from opposite sides of a lower end of the plug body 41 so as to be inserted into the above-described plug coupling recesses 31 of the socket 30. A fuse inserting bracket 43 is provided at one side of the plug body 41 to enable lateral insertion and fixation of the low-profile fuse 20.

The plug body 41 defines an upper section of the plug 40 and is longitudinally disposed on the upper surface of the junction box 10. The plug body 41 serves to prevent the plug 40 from being completely pushed down into the socket 30 while allowing the user to easily pull up or push down the plug 40 by hand. The plug body 41 is made of conventional synthetic resins.

The vertically-movable guides 42 are inserted into the plug coupling recesses 31 of the above-described socket 30 and serve to guide vertical movement of the plug 40 while preventing unintentional separation of the plug 40 from the socket 30. Preferably, to prevent the plug 40 from being tilted laterally during upward or downward movement thereof, the pair of vertically-movable guides 42 protrude from opposite sides of the lower end of the plug body 41. More preferably, to fixedly keep the plug 40 at the maximum upwardly or downwardly moved position, the plug 40 is formed at an outer surface thereof with protrusions 421 and 422 such that the protrusions 421 and 422 are caught by the plug coupling recesses 31 of the socket 30, preventing unnecessary movement of the plug 40 due to vibrations of a vehicle, etc.

The fuse inserting bracket 43 is provided at one side of the plug body 41, to allow the low-profile fuse 20 to be fixed to the plug body 41 while being exposed to the outside. The fuse inserting bracket 43 is formed, at opposite inner sides thereof, with a pair of symmetrical fuse fixing protrusions 431, by which opposite sides of the low-profile fuse 20 are fixedly caught. In a state wherein the low-profile fuse 20 is laterally inserted into the fuse inserting bracket 43 and is fixed by the pair of fuse fixing protrusions 431, the low-profile fuse 20 is still exposed from the plug 40 such that the connecting terminals 22 can be exposed from the plug body 41. Accordingly, as the low-profile fuse 20 is inserted into the fuse connecting recess 32, the connecting terminals 22 can achieve efficient connection with the above-described terminals inside the socket 30.

With the above-described configuration, the low-profile fuse 20 can be simply and firmly fixed to the plug 40 and in turn, can be connected to or disconnected from the junction box 10 via vertical movement of the plug 40 into or out of the socket 30.

Preferably, the above-described fuse inserting bracket 43 is further provided at an upper end thereof with fuse supporting protrusions 432 to support an expanded upper end portion 21 of the low-profile fuse 20 from the upper and lower sides of the fuse 20. When the low-profile fuse 20 is inserted into the fuse connecting recess 32, the fuse supporting protrusions 432 press an upper edge of the upper end portion 21 of the low-profile fuse 20, so as to achieve more efficient coupling between the low-profile fuse 20 and the plug 40. In addition, during upward movement of the plug 40, the fuse supporting protrusions 432 press a lower edge of the upper end portion 21 of the low-profile fuse 20 so as to achieve efficient movement of the low-profile fuse 20 while preventing the low-profile fuse 20 being unintentionally separated from the fuse inserting bracket 43.

Preferably, each of the above-described plug coupling recesses 31 is formed at inner surfaces thereof with indentations (not shown), into which the above-described protrusions 421 and 422 are fixedly inserted at the maximum upwardly or downwardly moved position of the plug 40. Once being inserted into the indentations, the protrusions 421 and 422 can be separated from the indentations only when a strong external force is applied thereto to induce vertical movement of the plug 40. This has the effect of preventing the low-profile fuse 20 from being unintentionally connected to or disconnected from the junction box 10 due to various vibrations and shocks of a vehicle at the maximum upwardly or downwardly moved position of the plug 40.

Preferably, the above-described vertically movable guides 42 are formed as discrete portions protruding downward from opposite sides of the plug body 41 with a distance therebetween, providing the plug 40 with an upside down U-shaped cross section, and the protrusions 421 and 422 are formed at outer surfaces of the vertically movable guides 42. With this configuration, the vertically movable guides 42 can exhibit elastic flexibility, achieving not only efficient vertical movement thereof when being inserted into the plug coupling recesses 31, but also firm and reliable engagement between the protrusions 421 and 422 and the indentations.

Figure 2:
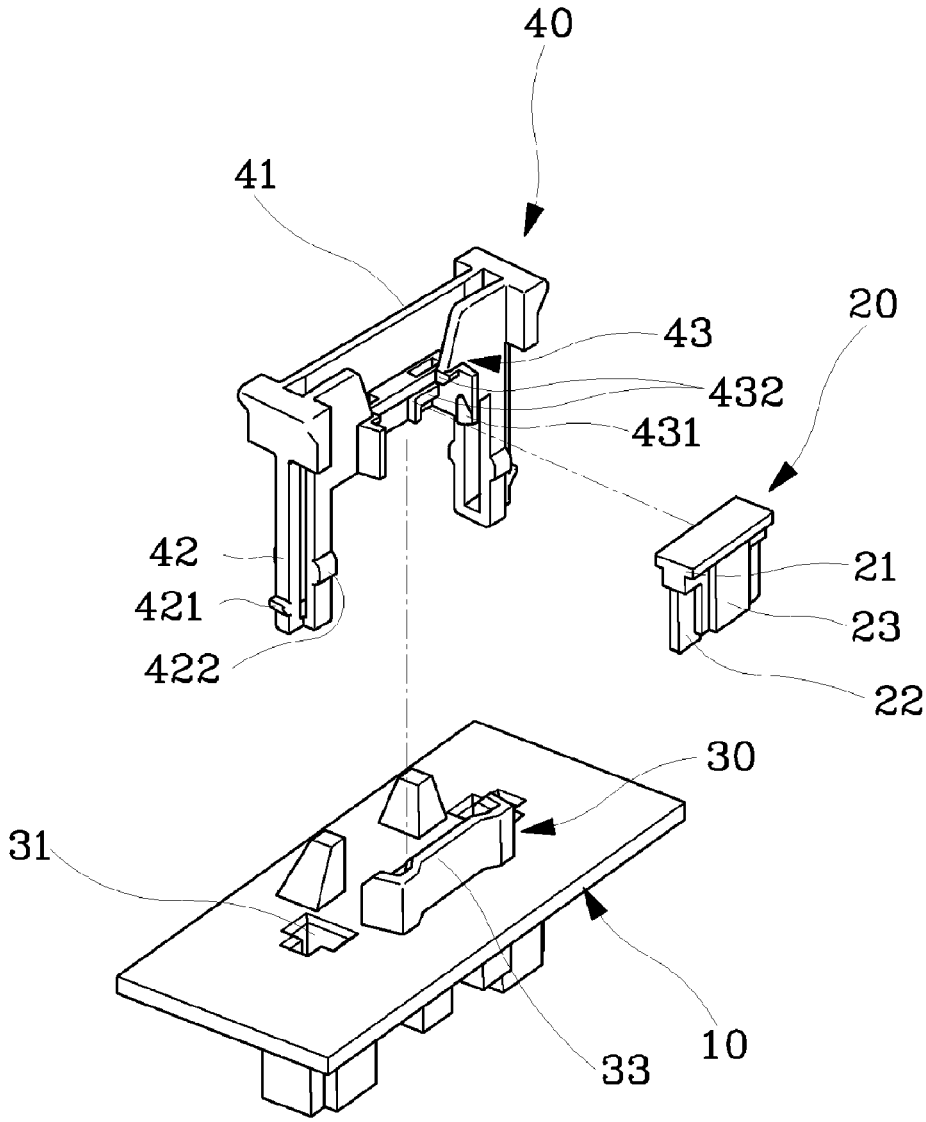
FIG. 2 is an exploded perspective view of a second embodiment of the present invention.

The second embodiment shown in FIG. 2 includes all the constituent elements of the above-described first embodiment, and additionally, includes a supporting wall 33, which protrudes upward from the upper surface of the junction box 10 at the outside of the above-described fuse connecting recess 32 and serves to support a sidewall 23 of the low-profile fuse 20. The supporting wall 33 can prevent the low-profile fuse 20 from being tilted laterally during vertical movement of the plug 40.

Preventing lateral tilting of the low-profile fuse 20 inserted into the fuse connecting recess 32 can eliminate defective connection due to the tilted posture of the low-profile fuse 20 and breakage of the low-profile fuse 20, and the like.

Figure 3:
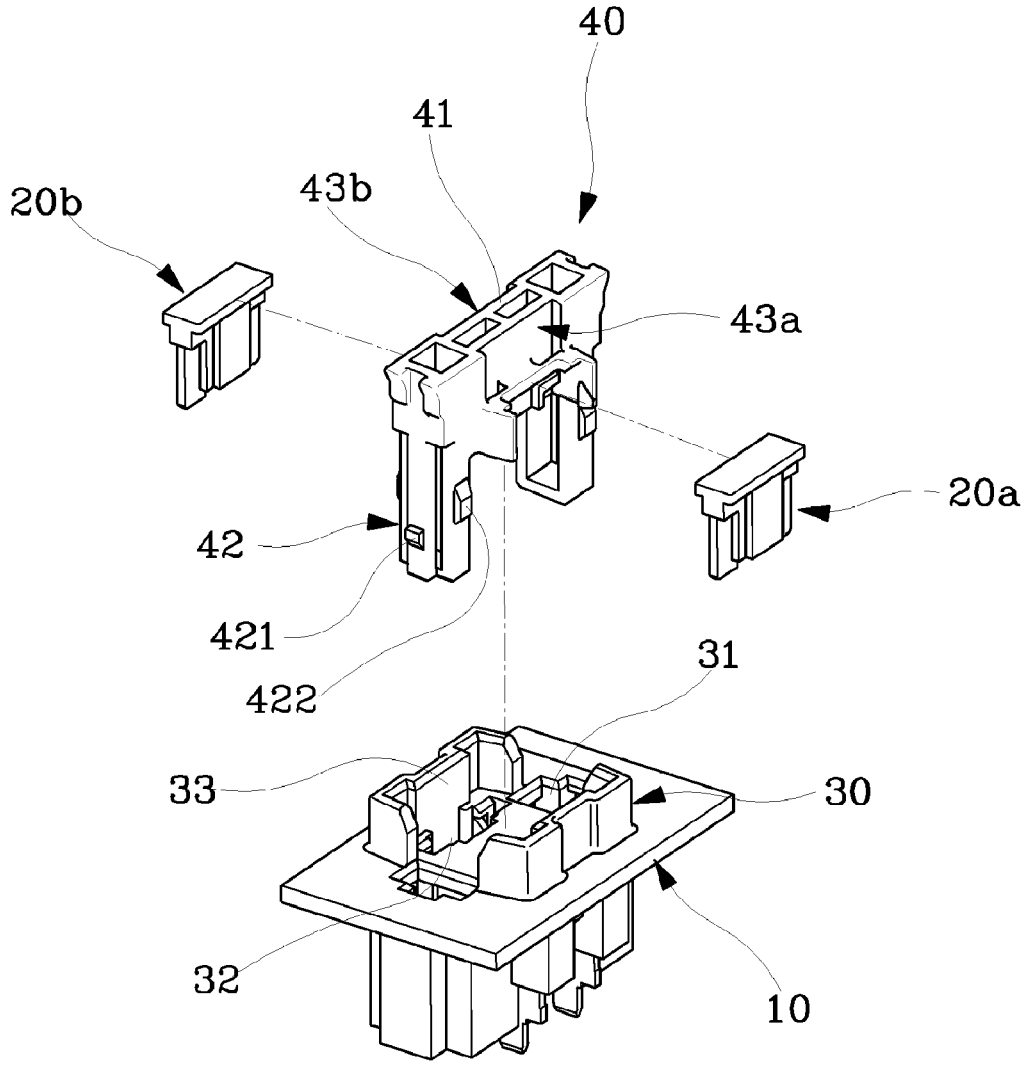
FIG. 3 is an exploded perspective view of a third embodiment of the present invention.
Figure 4:
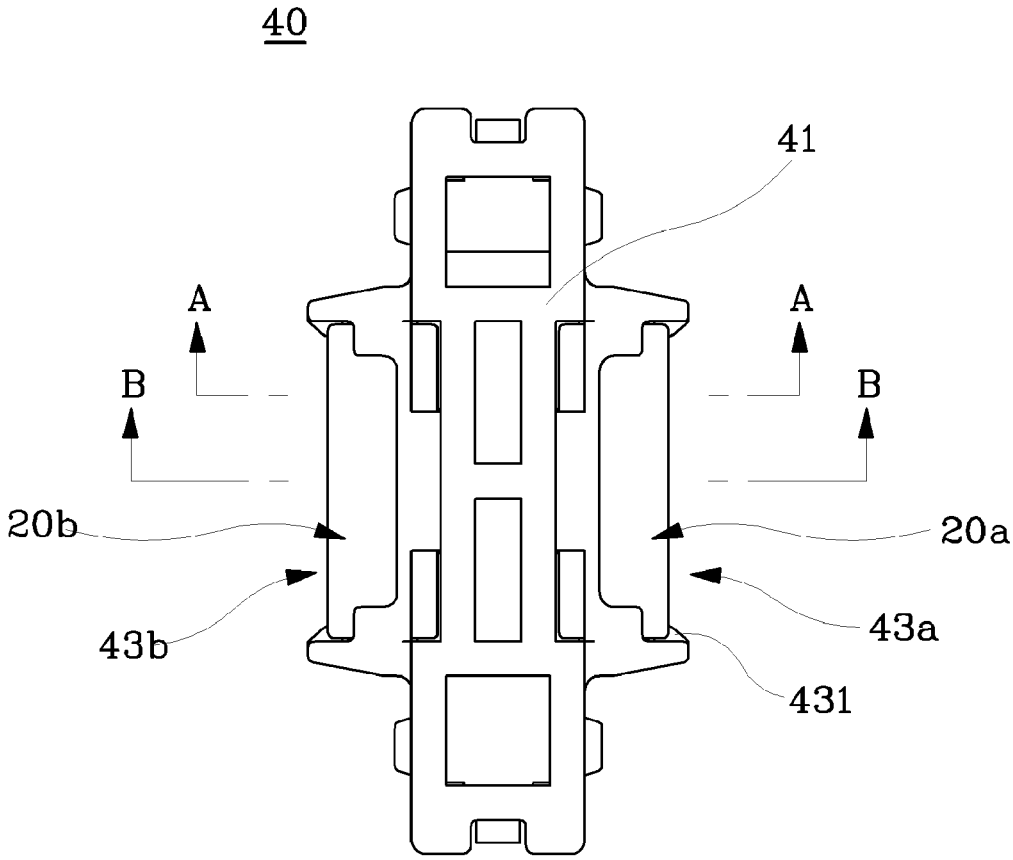
FIG. 4 is a plan view of the plug shown in FIG. 3.
Figure 5A:
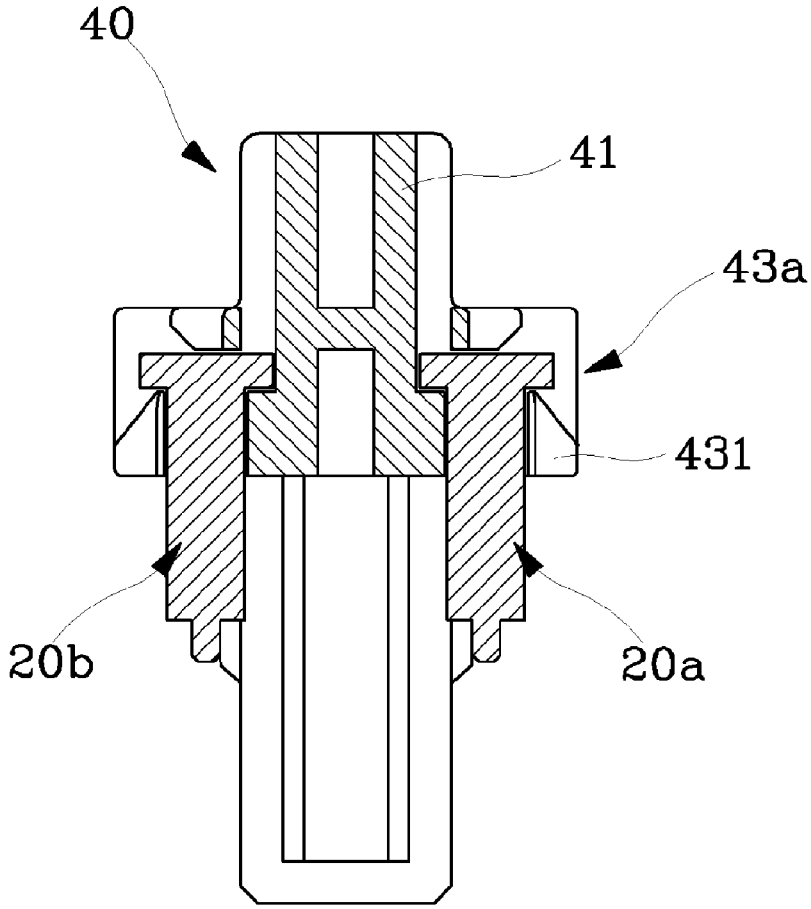
FIG. 5A is a sectional view taken along the line A-A of FIG. 4.
Figure 5B:
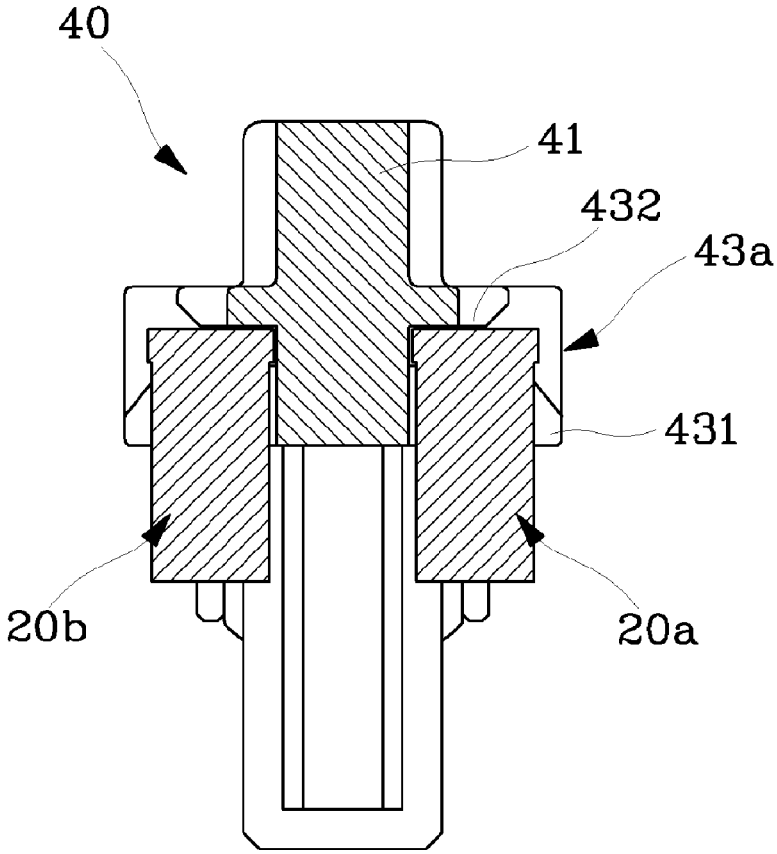
FIG. 5B is a sectional view taken along the line B-B of FIG. 4.
Figure 6:
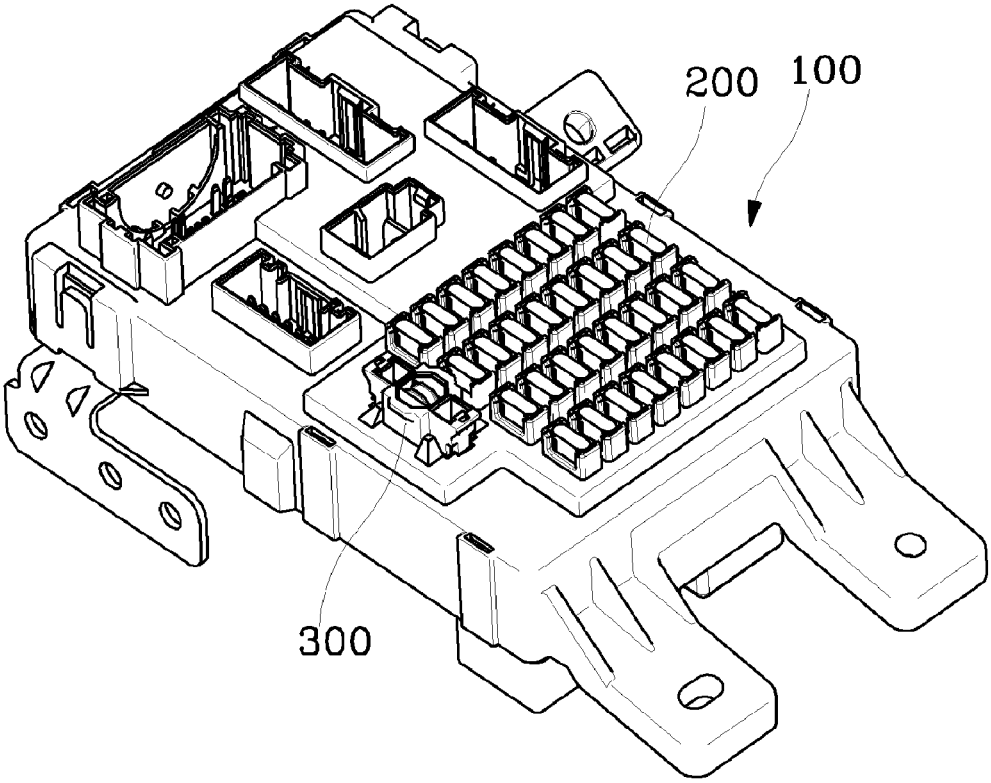
FIG.6 Prior Art
FIG. 6 is a perspective view illustrating one example of a conventional vehicular junction box.
Figure 7:
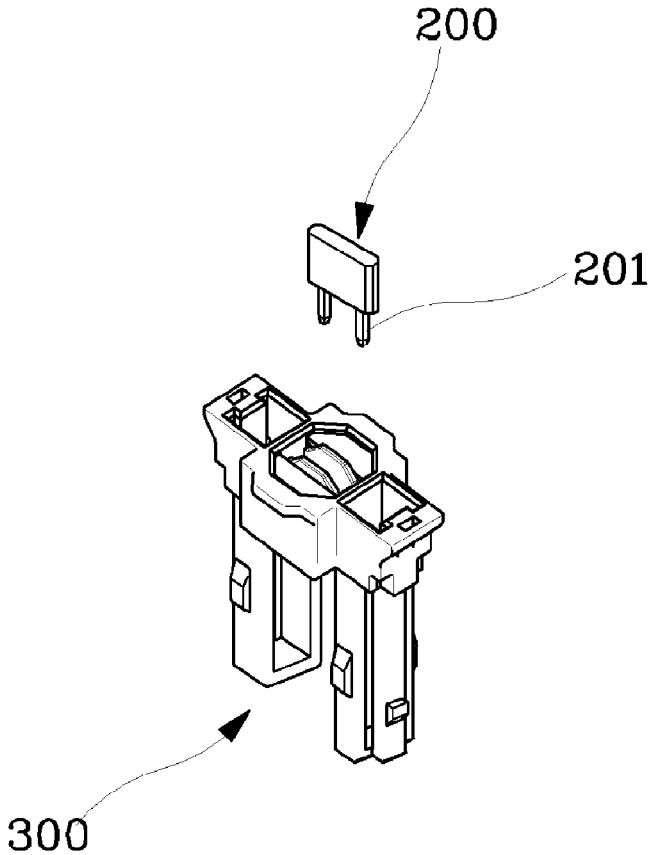
FIG.7 Prior Art
FIG. 7 is a perspective view of a conventional fuse fastening device.

FIG. 4 is a plan view of a plug 40 shown in FIG. 3 illustrating a third embodiment of the invention, and FIG. 5 shows a coupling relationship between a low-profile fuse 20 and a plug 40, FIG. 5A being a sectional view taken along the line A-A of FIG. 4, and FIG. 5B being a sectional view taken along the line B-B of FIG. 4. The third embodiment includes all the constituent elements of the above-described embodiments, and additionally, includes a pair of fuse inserting brackets 43*a* and 43*b*, which are symmetrically formed at opposite sides of the plug body 41, to allow a pair of low-profile fuses 20*a* and 20*b* to be simultaneously coupled to the single plug 40.

Accordingly, the pair of low-profile fuses 20*a* and 20*b* can be simultaneously connected to or disconnected from the junction box 10 through vertical movement of the single plug 40, enabling easy adjustment in connection of a plurality of low-profile fuses. This also can allow the low-profile fuses to occupy a reduced space in the junction box 10, resulting in a reduction in the overall size of the junction box 10.

As apparent from the above description, the present invention provides a fastening device for a low-profile vehicular fuse 20 having the following effects.

Firstly, according to the present invention, the fastening device can achieve not only simple separation/coupling of the low-profile fuse 20, but also efficient connection between the low-profile fuse 20 and a junction box 10 while maintaining plug-and-socket coupling thereof. As a result, when it is desired to disconnect the low-profile fuse 20 used in the junction box 10, the disconnection can be accomplished without completely separating the low-profile fuse 20 from the junction box 10. This has the effect of preventing the loss of the low-profile fuse 20 and simplifying connection/disconnection between the low-profile fuse 20 and the junction box 10.

Secondly, when the fastening device further includes a supporting wall 33, the fastening device can prevent the low-profile fuse 20 from being tilted laterally during vertical movement of a plug 40 thereof, allowing the low-profile fuse 20, coupled to the plug 40, to be more efficiently coupled into a fuse connecting recess 32 of a socket 30 of the fastening device.

Thirdly, the plug 40 of the fastening device has a simplified configuration consisting of a plug body 41, vertically-movable guides 42 and a fuse inserting bracket 43, and can be efficiently vertically moved in the socket 30. Through use of the simplified plug 40, the present invention can achieve firm fixation of the low-profile fuse 20, simplified coupling between the plug 40 and the low-profile fuse 20, and convenient operation of the resulting fastening device.

Fourthly, when providing the fuse inserting bracket 43 with fuse supporting protrusions 432, the fastening device can achieve enhanced coupling force of the low-profile fuse 20 during downward movement of the plug 40. Accordingly, when the low-profile fuse 20 is connected to the socket 30, it is possible to prevent the low-profile fuse 20 from being unintentionally separated from the plug 40 while achieving more efficient connection of the low-profile fuse 20.

Fifthly, according to the present invention, plug coupling recesses 31 are formed in the socket 30 and in turn, each coupling recess is formed at an inner surface thereof with indentations serving to firmly fix the plug 40 at the maximum upwardly or downwardly moved position thereof. This can further prevent unintentional connection or disconnection of the low-profile fuse 20 due to the weight and vibrations of the plug 40 and low-profile fuse 20.

Sixthly, a pair of fuse inserting brackets 43*a* can be provided at opposite sides of the plug body 41 to enable simultaneously coupling of a pair of low-profile fuses 20*a* in a simplified manner, resulting in an improvement in convenience of use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fastening device for low-profile fuses of a vehicle, the fastening device comprising:

a socket integrally formed at an upper surface of a junction box and having a pair of plug coupling recesses and a fuse connecting recess, which are indented in the upper surface of the junction box;

terminals being disposed inside the fuse connecting recess so as to be exposed to the outside; and, a plug having a plug body and a fuse inserting bracket, the plug body configured to allow a user to simply grip the plug by hand and serving to support the low-profile fuse, the fuse inserting bracket provided at a lateral side of the plug body;

wherein the plug is vertically movably coupled in the socket while being coupled laterally with the low-profile fuse having laterally-protruding connecting terminals to enable connection or disconnection between the low-profile fuse and the terminals inside the fuse connecting recess.

2. The fastening device according to claim 1, further comprising:

a supporting wall protruding from the upper surface of the junction box at the outside of the fuse connecting recess and serving to support a sidewall of the low-profile fuse.

3. The fastening device according to claim 1, wherein the plug further comprises a pair of vertically movable guides protruding downward from opposite sides of the plug body so as to be vertically movably inserted into the respective plug coupling recesses and each having a protrusion to be fixedly caught at an upwardly or downwardly moved position of the plug.

4. The fastening device according to claim 3, wherein the plug further comprises a fuse fixing protrusion.

5. The fastening device according to claim 4, wherein the fuse inserting bracket further comprises a fuse supporting protrusion formed at an upper end thereof to support an upper end of the low-profile fuse.

6. The fastening device according to claim 4, wherein the fuse inserting bracket includes a pair of fuse inserting brackets symmetrically provided at both sides of the plug body.

7. The fastening device according to claim 1, wherein each of the fuse coupling recesses is formed at an inner surface thereof with an indentation corresponding to the protrusion.

8. The fastening device according to claim 4, wherein the fuse inserting bracket includes a pair of fuse inserting brackets symmetrically provided at both sides of the plug body.

9. A fastening device for low-profile fuses of vehicle, the fastening device comprising:

a socket integrally formed at an upper surface of a junction box and having a pair of plug coupling recesses and a fuse connecting recess, which are indented in the upper surface of the junction box;

terminals being disposed inside the fuse connecting recess so as to be exposed to the outside;

a plug vertically movably coupled in the socket while being coupled laterally with the low-profile fuse having laterally-protruding connecting terminals to enable connection or disconnection between the low-profile fuse and the terminals inside the fuse connecting recess; and a supporting wall protruding from the upper surface of the junction box at the outside of the fuse connecting recess and serving to support a sidewall of the low-profile fuse.

10. The fastening device according to claim 9, wherein the plug comprises:

a plug body configured to allow a user to simply grip the plug by hand and serving to support the low-profile fuse.

11. The fastening device according to claim 10, wherein the plug further comprises a pair of vertically movable guides protruding downward from opposite sides of the plug body so as to be vertically movably inserted into the respective plug coupling recesses and each having a protrusion to be fixedly caught at an upwardly or downwardly moved position of the plug.

12. The fastening device according to claim 11, wherein the plug further comprises a fuse inserting bracket provided at a side of the plug body and a fuse fixing protrusion.

13. The fastening device according to claim 12, wherein the fuse inserting bracket further comprises a fuse supporting protrusion formed at an upper end thereof to support an upper end of the low-profile fuse.

14. The fastening device according to claim 10, wherein each of the fuse coupling recesses is formed at an inner surface thereof with an indentation corresponding to the protrusion.

* * * * *